US012116088B2

(12) United States Patent
Rosengren

(10) Patent No.: US 12,116,088 B2
(45) Date of Patent: Oct. 15, 2024

(54) STERN PLATFORM ARRANGEMENT AND MARINE VESSEL

(71) Applicant: Volvo Penta Corporation, Gothenburg (SE)

(72) Inventor: Christofer Rosengren, Gothenburg (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 345 days.

(21) Appl. No.: 17/450,786

(22) Filed: Oct. 13, 2021

(65) Prior Publication Data

US 2022/0126953 A1 Apr. 28, 2022

(30) Foreign Application Priority Data

Oct. 22, 2020 (EP) ..... 20203289

(51) Int. Cl.
*B63B 27/14* (2006.01)
*B63B 29/02* (2006.01)
(Continued)

(52) U.S. Cl.
CPC ..... *B63B 27/146* (2013.01); *B63H 20/08* (2013.01); *B63H 20/10* (2013.01); *B63B 2029/022* (2013.01); *B63B 2029/043* (2013.01)

(58) Field of Classification Search
CPC ..... B63B 2027/14; B63B 2027/141; B63B 2029/043; B63B 27/146; B63B 2027/148;
(Continued)

(56) References Cited

U.S. PATENT DOCUMENTS 1,118,208 A * 11/1914 McLaren ..... B63H 20/06 248/641
2,747,536 A * 5/1956 Russell ..... B63B 35/665 114/77 R
(Continued)

FOREIGN PATENT DOCUMENTS

CN 111688897 A * 9/2020
FR 2862273 A1 5/2005
KR 20110006096 A * 1/2011

OTHER PUBLICATIONS

European Search Report dated Apr. 26, 2021 in corresponding European Patent Application No. 20203289.2, 5 pages.

*Primary Examiner* — Ajay Vasudeva
(74) *Attorney, Agent, or Firm* — Venable LLP; Jeffri A. Kaminski

(57) ABSTRACT

The invention relates to a platform arrangement (110) mounted to a stern portion of a marine vessel (100). The platform arrangement comprises at least one first platform section (111) with a first transverse pivot joint (113) mounted adjacent a transom (105); at least one propulsion unit (101) mounted to a lower surface of the first platform section (111), wherein the at least one propulsion unit (101) and its first platform section (111) are tiltable between a drive position and an upwards tilted position. A second platform section (112) is located in front of the at least one first platform section (111), which second platform section (112) has a second transverse pivot joint (114) mounted adjoining the first transverse pivot joint (113) of a corresponding first platform section (111). The first and second platform sections (112) are foldable relative to each other about their respective first and second pivot joints (113; 114). The invention further relates to a vessel comprising the platform arrangement.

15 Claims, 6 Drawing Sheets

(51) Int. Cl.
*B63B 29/04* (2006.01)
*B63H 20/08* (2006.01)
*B63H 20/10* (2006.01)

(58) Field of Classification Search
CPC ..... B63B 2029/022; B63H 5/125; B63H 5/1252; B63H 20/007; B63H 20/06; B63H 20/08; B63H 20/10; B63H 2020/103; B63H 20/106; B63H 20/22
See application file for complete search history.

(56) References Cited

U.S. PATENT DOCUMENTS 2,794,410 A * 6/1957 Oliver ..... B63B 35/665 440/58
3,805,722 A * 4/1974 Melchert, Jr. ..... B63B 35/14 114/343
3,858,541 A 1/1975 Metcalf et al.
3,866,562 A * 2/1975 Pazos ..... B63B 17/0018 440/55
4,000,712 A * 1/1977 Erikson ..... B63H 21/305 114/77 R
4,085,473 A * 4/1978 Franklin ..... B63B 17/04 114/364
4,669,414 A * 6/1987 Molino ..... B63B 27/14 114/343
5,842,895 A * 12/1998 DeVito, Jr. ..... B63H 20/007 440/6
5,848,921 A * 12/1998 Mochida ..... B63H 5/125 440/61 R
8,096,252 B2 * 1/2012 Huang ..... B63H 5/125 114/77 R
2006/0189225 A1 8/2006 Maselter
2012/0028517 A1 2/2012 Mochizuki et al.
2017/0129573 A1 5/2017 Fafard
2018/0354589 A1 12/2018 Wood

* cited by examiner

STERN PLATFORM ARRANGEMENT AND MARINE VESSEL

TECHNICAL FIELD

The present invention relates to a stern platform arrangement mounted to a marine vessel.

BACKGROUND

Known marine vessels comprising a stern platform, such as a swim platform, are often provided with a propulsion unit in the form of a stern drive driven by an internal combustion engine (ICE) arranged within the hull of the vessel. Torque is then transmitted from the ICE to the stern drive via a transmission comprising shafts and gearing in order to drive a set of propellers on the stern drive.

Mounting a drive unit and the transmission required for such a drive unit within the hull of the vessel can require a significant amount of space. In operation, heat from the drive unit must be removed using a cooling system which as a rule employs water drawn in from the ambient marine environment. This often involves drawing in saline water from the sea and pumping it through the coolant system, which can cause problems with corrosion. Further, a vibration generated by rotary components in the drive unit and the transmission requires vibration isolation and dampers to be installed to avoid undesirable vibrations from being transmitted to the hull or other parts of the vessel. Finally, the transmission must pass through the transom of the vessel to reach the stern drive and the propellers. This requires a suitable sealing arrangement between an opening in the transom and a rotary transmission shaft to prevent water from leaking through the hull.

Further, when the vessel is provided with a stern swim platform it is often difficult to access a stern drive, as the swim platform can extend a fair distance aft of the transom. This creates a problem not only for access during maintenance, but also for a simple visual inspection of the stern drive and its propellers.

The invention provides an improved stern platform arrangement aiming to solve the above-mentioned problems.

SUMMARY

An object of the invention is to provide a stern platform arrangement for a marine vessel, which arrangement solves the above-mentioned problems.

The object is achieved by a stern platform arrangement and a marine vessel comprising such a stern platform arrangement according to the appended claims.

In the subsequent text, the term "propulsion unit" is defined as an assembly comprising an outdrive having two sub-units. An upper unit contains drive units and a transmission and is enclosed in an upper drive housing. A lower unit contains a vertical driveshaft receiving power from the transmission in the upper unit and a gearbox providing power to a propeller shaft for driving at least one propeller. The component parts of the lower unit are enclosed in a gearbox housing. The upper and lower units are separated by a cavitation plate. A propulsion unit according to the invention differs from a conventional stern drive in that it does not comprise an inboard drive unit. The vessel is steered by pivoting the at least one propulsion unit or outdrive relative to the vessel, either by rotating the lower unit relative to the upper unit or by rotating the upper unit relative to a mounting attached to the vessel. The propulsion unit can be tilted up into a tilted position for trailer travel and between uses to avoid fouling.

According to a first aspect of the invention, the invention relates to a platform arrangement mounted to a stern portion of a marine vessel. The platform arrangement comprises at least one first platform section with a first transverse pivot joint mounted adjacent a transom and at least one propulsion unit mounted to a lower surface of the first platform section, wherein the at least one propulsion unit and the first platform section are tiltable between a drive position and an upwards tilted position.

The platform arrangement can further comprise a second platform section located in front of the at least one first platform section, which second platform section has a second transverse pivot joint mounted adjoining the first transverse pivot joint of a corresponding first platform section. The first and second platform sections are foldable relative to each other about their respective first and second pivot joints and are also individually foldable.

The at least one first platform section is arranged to extend rearwards from the first transverse pivot joint when the at least one propulsion unit is in its drive position. The first transverse pivot joint is preferably located forwards of and above the transom. In the drive position, the first platform section extends a sufficient distance aft of the transverse transom to allow at least one propulsion unit to be accommodated underneath the first platform section. Optionally, the at least one first platform section is arranged to be angled about the first transverse pivot joint for trim adjustment when the at least one propulsion unit is in its drive position. The first and second platform sections are arranged to form a continuous longitudinal deck portion when the at least one propulsion unit is in its drive position.

According to one example, the at least one first platform section is arranged to be angled upwards and forwards relative to the first transverse pivot joint when the at least one propulsion unit is displaced to its tilted position. Further, the second platform section is arranged to be angled upwards and rearwards relative to the second transverse pivot joint when the at least one propulsion unit is displaced to its tilted position. The angled first and second platform sections can then form a transverse seating unit when the at least one propulsion unit is in its tilted position.

According to a further example, individual first and second platform sections form a transverse seating unit for each propulsion unit when that propulsion unit is in its tilted position. In this way, separate portions of the platform arrangement can be folded one at the time, or all at once, to form separately adjustable seating units located side-by-side. Hence, a platform arrangement comprising two or more propulsion units would provide a longitudinally split platform with a number of seating units corresponding to the number of propulsion units. According to a further alternative, each portion of the platform arrangement can be provided with two or more propulsion units. The number of propulsion units and subdivisions of the platform arrangement is selected depending on factors such as available space below the platform, the size of the motors used and the size of the vessel.

In both examples, each of the first and the second platform sections forming one or more transverse seating units are individually adjustable, in the same way as a recliner chair. Consequently, the first platform section is folded upwards to an angle of up to about 80° from a horizontal plane and the second platform section is folded upwards to an angle of up to 45° from a horizontal plane when the platforms are deployed as a seating unit. The respective first and second pivot joints are preferably arranged in parallel, but can optionally also be arranged coaxially. In the latter case, opposing end portions of the first and second platform sections would be partially overlapping side-by side and be pivoted about the same axis.

According to a further example, the first platform section is folded upwards to an angle of 90-180° from a horizontal position into a position for servicing of the at least one propulsion unit. This involves pivoting the propulsion unit past its tilted position into a servicing, or maintenance position. For instance, pivoting the propulsion unit to an angle around 90° can provide easy access to the propulsion unit for general maintenance or for replacing parts thereof, such as a propeller. Pivoting the propulsion unit to an angle of 180° can be an option when the entire propulsion unit must be removed or exchanged, as the fastener means attaching the propulsion unit to the underside of the first platform section can be removed safely prior to lifting the propulsion unit off the vessel. In the case where the first and second pivot joints are arranged in parallel, the pivot joint of the first platform section could be provided with a suitable release mechanism to allow pivoting to 180°. For a coaxial solution, a common pivot axis would have to be located above the plane of the adjacent platform sections.

According to a further example, the at least one propulsion unit attached to the first platform section can preferably, but not necessarily, comprise an electric drive unit. Such an electric drive unit can in turn comprise one or more electric motors.

According to a second aspect of the invention, the invention relates to a marine vessel provided with a stern platform arrangement as described in the above examples.

The platform arrangement according to the invention solves the problem of providing a stern drive or outdrive with electric propulsion without requiring significant modifications of the hull or transom of a vessel. In most cases the outdrive can advantageously be provided with a drive housing having the same or approximately the same shape and size as a conventional stern drive housing. Further, the conventional interface for mounting a stern drive and its steering gear connections to a transom can be eliminated. Similarly, as a conventional inboard drive unit can be eliminated there is no need for an opening through the transom or for an associated sealing means for a drive shaft.

A further advantage is that the mounting of one or more propulsion units to a pivoting platform arrangement provides easy access to the propulsion unit for maintenance or for replacing parts thereof, such as a propeller. Pivoting the platform arrangement and the attached propulsion unit to an angle of 180° facilitates removal or exchange of the entire propulsion unit, as the fastener means attaching the propulsion unit to the underside of the first platform section can be removed safely prior to lifting the propulsion unit off the vessel. Thus, the vessel does not need to be lifted from the waters when performing service to the propulsion units.

A further advantage is that the foldable platform arrangement doubles as a seating unit when the one or more propulsion units are placed in a tilted position. On relatively small vessels, such as day cruisers and similar, the use of non-fixed seats is neither safe nor practical. At the same time, a user wearing a wet swimsuit may not want to use the standard upholstered seats. Integrating seating units into a platform arrangement such as a swim platform solves the problem of providing additional seating that is both water repellant and durable.

In this way the first and second platform sections are foldable relative to each other about their respective first and second pivot joints. The first and second platform sections are also individually foldable. A split platform arrangement allows the backrest portion and the seat portion of adjacent seating sections to be adjusted individually to desired angles.

A further advantage of the invention is that the provision of a planetary gear set allows relatively small, high speed electric motors to be used while maintaining a sufficient level of torque to the gearbox and propeller/-s. A planetary gear set can be accommodated within the cavitation plate, the stern drive can be kept relatively compact. The electric motors can drive the propellers together, independently or in variable combinations in response to different torque and power demands whereby the efficiency of the propulsion unit is improved. By allowing independent operation of at least a single motor the arrangement provides a redundancy for the propulsion unit and ensures that the vessel can be operated even if one or more electric motors are inoperable.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
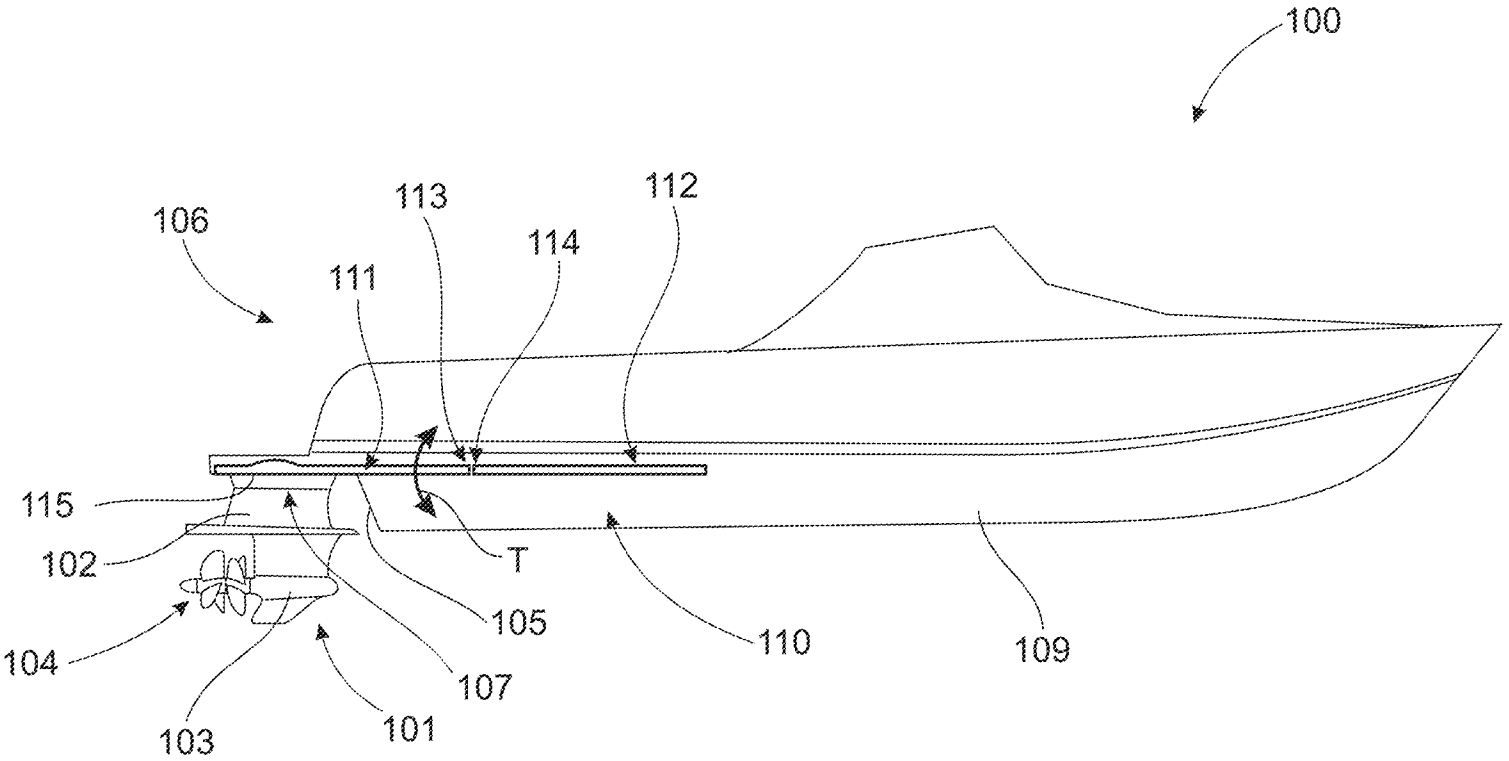
FIG. 1 shows a side view of a schematically illustrated vessel comprising a platform arrangement.

FIG. 1 shows a side view of a schematically illustrated marine vessel 100 comprising a marine propulsion unit 101. The marine propulsion unit 101 is mounted to a platform arrangement 110 mounted to a stern portion 106 of the vessel 100. The platform arrangement 110 comprises a first platform section 111 and a second platform section 112, which in FIG. 1 are arranged to form a continuous longitudinal deck portion. The first platform section 111 is attached to the stern portion 106 by a first transverse pivot joint 113 mounted adjacent a transom 105 forming a transverse rear portion of the vessel hull 109. The second platform section 112 is located in front of the first platform section 111 and is attached to the stern portion 106 by a second transverse pivot joint 114 mounted adjoining the first transverse pivot joint 113 of the first platform section 111. In this configuration, the first platform section 111 forms a substantially horizontal rear platform section, extending rearwards past the transom 105, and the second platform section 112 forms a substantially horizontal front platform section. The platform configuration in FIG. 1 is used when the marine propulsion unit 101 is in its drive position, in which it is used to propel the marine vessel 100. Alternatively, when the propulsion unit 101 is not being operated, this platform configuration can be used as a swim platform.

The propulsion unit 101 in FIG. 1 is an electric drive unit comprising at least one electric motor (not shown) arranged within a drive housing 102 that is mounted to a lower surface 115 of the rear platform section 111. The marine propulsion unit 101 can be connected to an inboard battery pack (not shown) via suitable wiring. The battery pack is preferably located below the waterline of the vessel hull 109 where it can act as ballast and contribute to the stability of the vessel 100. The drive housing 102 is connected to a gearbox housing 103 provided with a set of propellers 104. FIG. 1 shows a drive unit 101 with pushing propellers, but the use of pulling propellers are also possible within the scope of the invention. In order to steer the vessel, the propulsion unit 101 is provided with an interface 107 mounted between the drive housing 102 and the lower surface 115 of the first platform section 111. The interface 107 allows for rotation of the propulsion unit 101 relative to the first platform section 111.

Although the example in FIG. 1 only shows one propulsion unit it is possible to use two or more units within the scope of the invention. The number of propulsion units is limited by the size of the platform arrangement and the vessel to which it is mounted.

Figure 2:
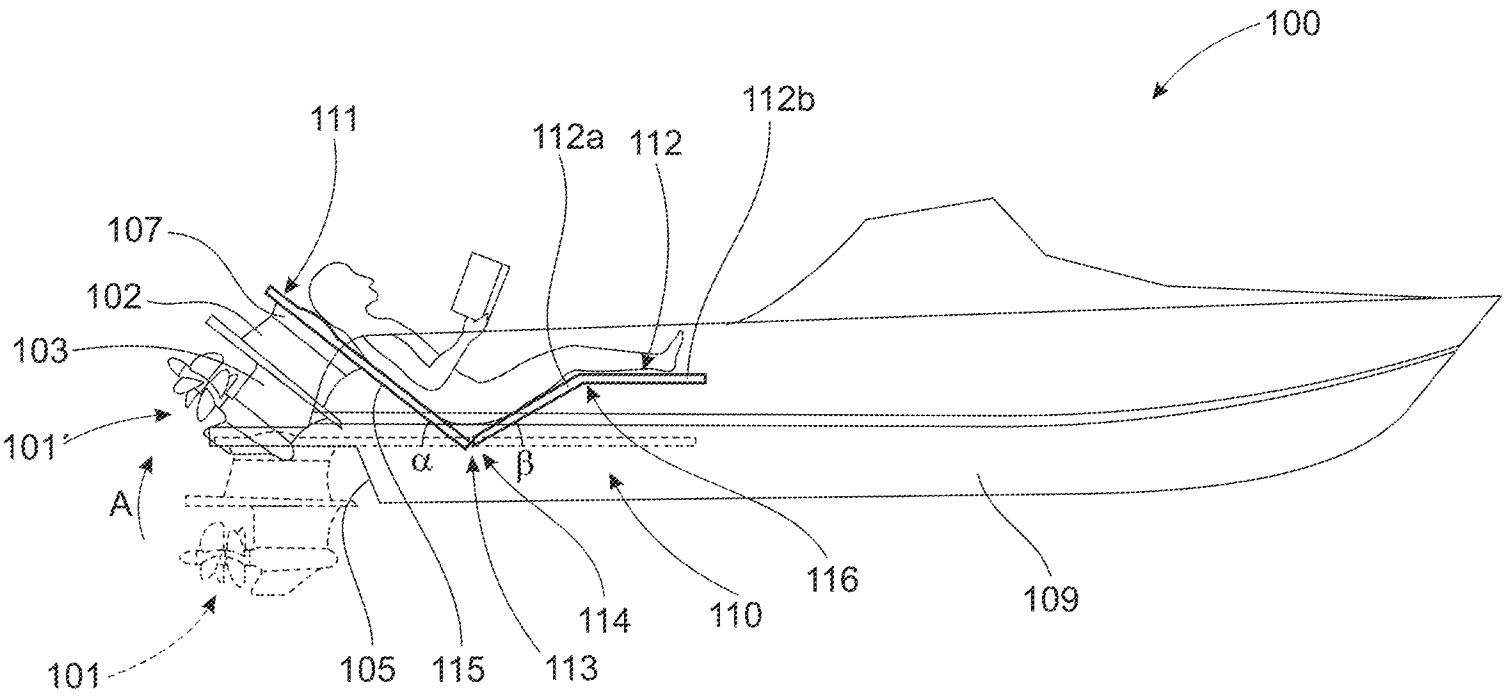
FIG. 2 shows the platform arrangement in FIG. 1 in an alternative configuration.

FIG. 2 shows a schematic perspective view of the platform arrangement 110 in FIG. 1 adjusted into an alternative configuration. In the example shown in FIG. 2, the first platform section 111 is arranged to be angled upwards and forwards relative to the first transverse pivot joint 113 when the propulsion unit 101 (indicated in dashed lines) is being displaced in the direction of the arrow A, from its drive position upwards into a tilted position indicated by the propulsion unit 101'. The first platform section 111 can be angled upwards separately from or together with the second platform section 112. The second platform section 112 can be angled upwards and rearwards relative to the second transverse pivot joint 114 at the same time as, or after, the propulsion unit 101' is displaced to its tilted position.

In their respective angled positions, the angled first and second platform sections 111, 112 form a transverse seating unit when the propulsion unit 101' is in its tilted position. The angled first and second platform sections 111, 112 are individually adjustable by a user into desired seating positions, in the same way as a reclining chair. For instance, when used as a seat, the first platform section 111 can be folded steplessly upwards to an angle α of 80° from a horizontal plane to form a backrest, while the second platform section 112 can be folded steplessly upwards to an angle ß of 45° from a horizontal plane to form a leg rest when deploying the seating unit. As shown in FIG. 2, the second platform section 112 is preferably divided into first and second subsections 112*a*, 112*b* connected by a third transverse pivot joint 116. This allows the first subsection 112*a* and the second subsection 112*b*, supporting the thigh and lower leg respectively, to be adjusted into a desired position. As shown in FIG. 2, the second subsection 112*b* can be angled downwards relative to the first subsection 112*a* into a substantially horizontal position, or lower if desired. The relative angles of the transverse seating unit can be selected freely by the user, within the limits of a number of controllable actuators connected to the different sections of the seating unit.

Figure 3:
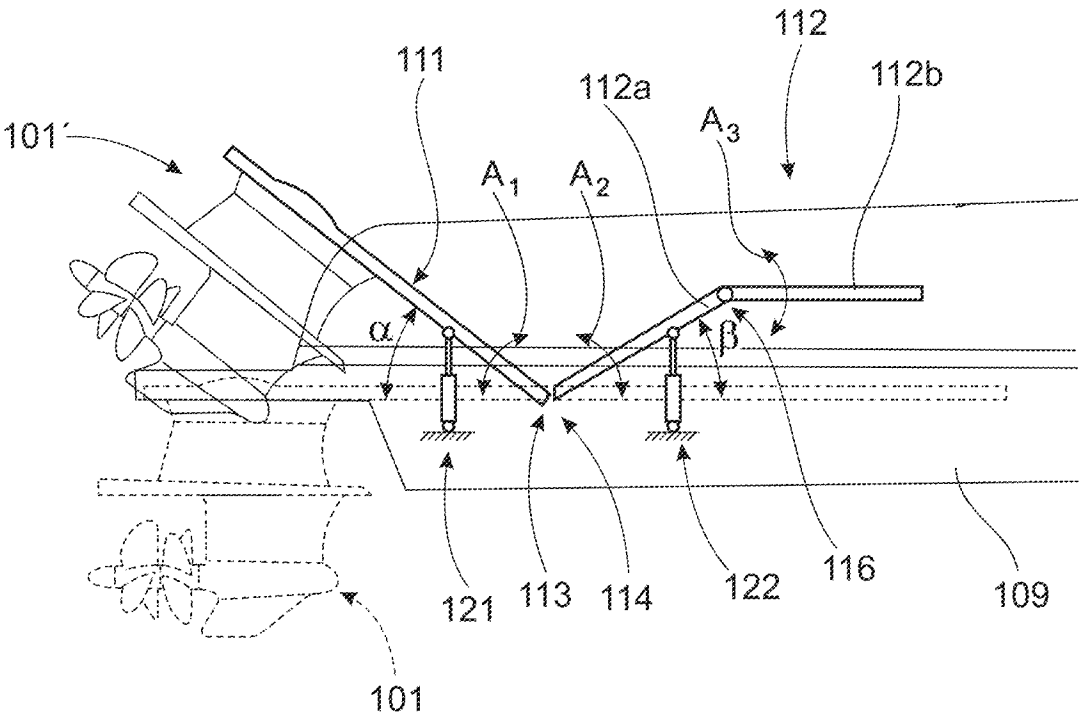
FIG. 3 shows an enlarged view of a seating unit indicated in FIG. 2.

FIG. 3 shows an enlarged view of the seating unit indicated in FIG. 2. As in FIG. 2, the propulsion unit 101 (indicated in dashed lines) has been displaced from its drive position upwards into a tilted position indicated by the propulsion unit 101'. The first platform section 111 has been folded upwards an angle α from a horizontal plane to form a backrest, as indicated by the arrow $A_1$. The first subsection 112*a* of the second platform section 112 has been folded upwards an angle ß from a horizontal plane to form a leg rest when deploying the seating unit, as indicated by the arrow $A_2$. The first and second subsections 112*a*, 112*b* dividing the second platform section 112 are angled relative to each other about the third transverse pivot joint 116, which subsections can provide individual support for the thigh and lower leg respectively. The second subsection 112*b* is folded about the third transverse pivot joint 116 as indicated by the arrow $A_3$. The angle of the first platform section 111 is controlled by a schematically indicated actuator 121. Similarly, the angle of the first subsection 112*a* of the second platform section 112 is controlled by a schematically indicated actuator 122. A non-exhaustive list of suitable actuators for this purpose comprises electric, hydraulic or pneumatic actuators. The actuators can be mounted in a number of different ways, depending on parameters such as the load to be supported, available space and the required stroke of the actuator. Larger installations can also require multiple actuators for each platform section. FIG. 3 shows one possible arrangement where a pair of upright actuators 121, 122 is connected to a lower surface of the respective platform section 111, 112*a*. Alternatively, electric motors can act on the respective platform section about their respective hinges. A further alternative can involve actuators arranged in the longitudinal direction of the vessel, which actuator can act on cantilevered sections of the respective platform section 111, 112*a*. Cantilevered sections of the respective platform section 111, 112*a* would extend past the respective pivot joint 113, 114 in a downward angled direction towards one or more actuators. The angle of the second subsection 112*b* relative to the first subsection 112*a* can be controlled by a mechanical linkage or a further actuator (not shown).

In addition, the actuator 121 used for maneuvering the first platform section 111 can also be operated to angle the first platform section 111 about the first transverse pivot joint for trim adjustment, or tilt trim, of the propulsion unit 101 when it is in its drive position and operated to propel the vessel. The trim adjustment about the first transverse pivot joint 113 is schematically indicated by the arrow T in FIG. 1. The angular adjustment required for trim adjustment is performed separately from the second platform section 112 by using the same actuator(s) implementing a tilt displacement.

Figure 4:
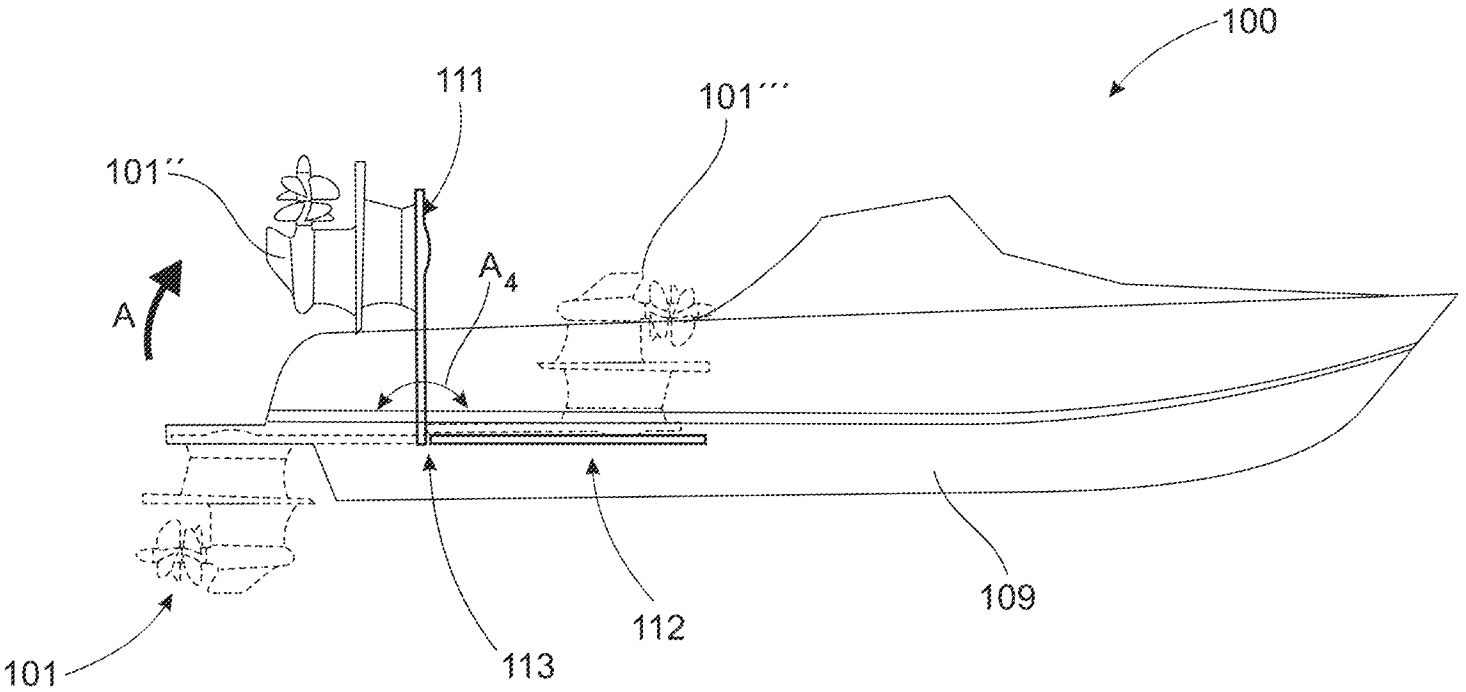
FIG. 4 shows the platform arrangement in FIG. 1 in a further alternative configuration.

FIG. 4 shows a schematic perspective view of the platform arrangement 110 in FIG. 1 adjusted into a further alternative configuration. In the example shown in FIG. 4, the first platform section 111 is arranged to be angled upwards and forwards relative to the first transverse pivot joint 113 to an angle of 90° from a horizontal position. In this way, the propulsion unit 101 would be moved from a vertical drive position (shown in dashed lines) to a second position where the propulsion unit 101" can be serviced. According to a further example, the first platform section 111 can be arranged to be angled upwards and forwards up to 180°, indicated by the arrow $A_4$, from the initial horizontal position as shown in FIG. 1. In the latter example, the propulsion unit 101''' (indicated in dashed lines) would be upside-down and the first platform section 111 would rest on top of the second platform section 112. By allowing the first platform section 111 to be angled in a stepless manner or into a number of fixed positions, such as 90° or 180°, the propulsion unit is easily accessible for service or removal/exchange. Tilting the first platform section 111 into such a service position can be possible using the same actuator(s) as for the tilting action into a backrest position (see FIG. 2). If the actuator(s) have a limited range that does not permit tilting up to or past 90°, then it can be necessary to disconnect the actuator and perform the displacement manually.

Figure 5:
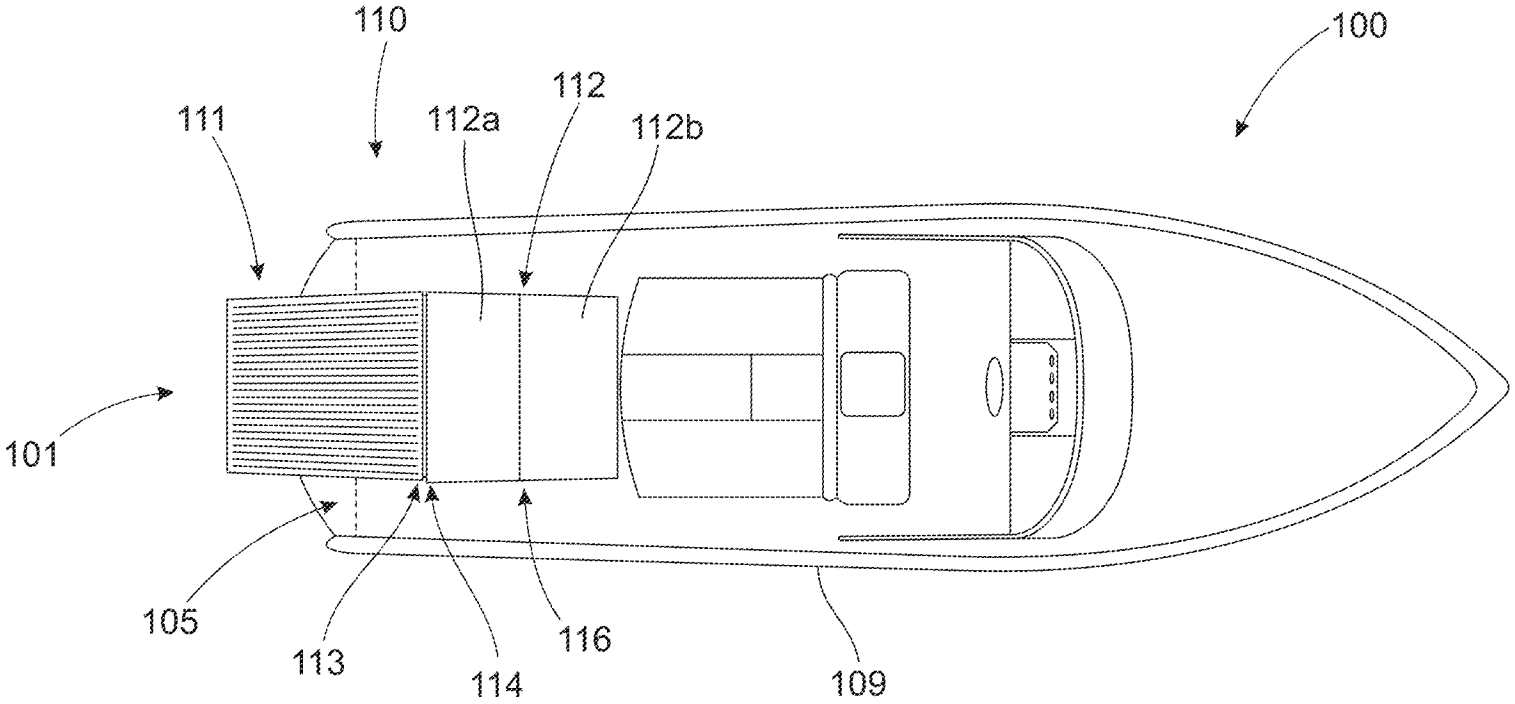
FIG. 5 shows a schematic plan view of a schematically illustrated vessel comprising a platform arrangement.

FIG. 5 shows a schematic plan view of a marine vessel 100 comprising a platform arrangement 110 as shown in FIG. 1. The platform arrangement 110 comprises a first platform section 111 and a second platform section 112, which in FIG. 5 are arranged to form a continuous longitudinal deck portion. The first platform section 111 is attached to the stern portion 106 by a first transverse pivot joint 113 mounted adjacent a transom 105 forming a transverse rear portion of the vessel hull 109. The second platform section 112 is located in front of the first platform section 111 and is attached to the stern portion 106 by a second transverse pivot joint 114 mounted adjoining the first transverse pivot joint 113 of the first platform section 111. The second platform section 112 is divided into first and second subsections 112*a*, 112*b* connected by a third transverse pivot joint 116, which subsections provide individual support for the thigh and lower leg respectively, if positioned in a seating position. The platform arrangement 110 comprises a propulsion unit 101, which in this example is an electric drive unit comprising at least one electric motor (not shown) arranged within a drive housing (see FIG. 1) that is mounted to the lower surface of the rear platform section 111.

Figure 6:
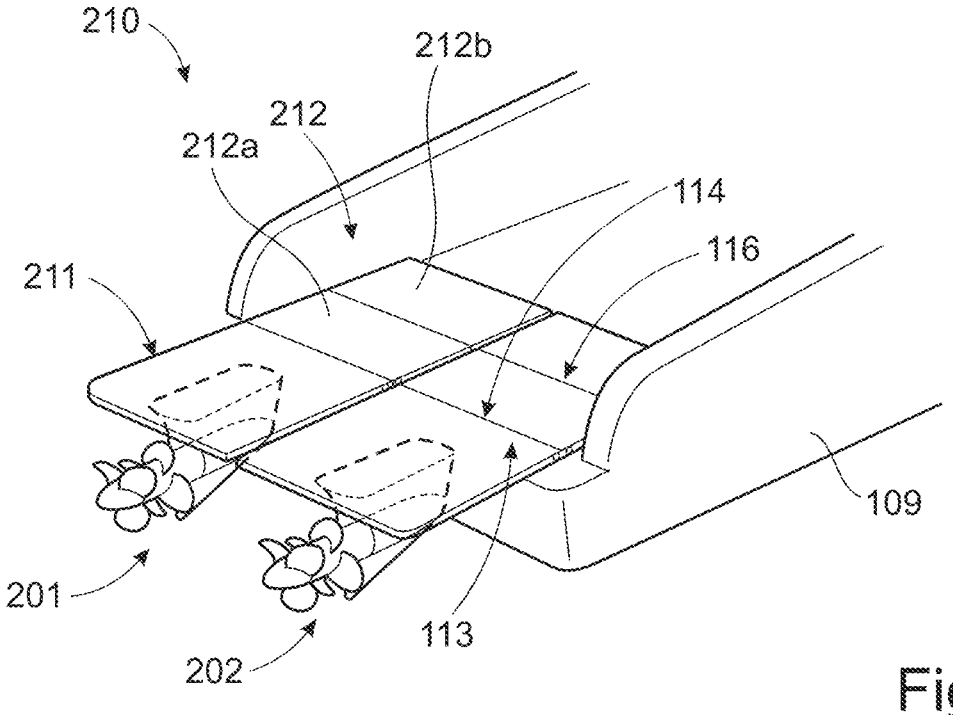
FIG. 6 shows a schematic perspective view of a split platform arrangement.

FIG. 6 shows a schematic perspective view of a split platform arrangement; and FIG. 6 shows a marine vessel comprising two marine propulsion units 201, 202. The first and second propulsion units 201, 202 are attached side-by-side to a platform arrangement 210 mounted to a stern portion of the vessel in the same way as described above. The platform arrangement 210 is split in the longitudinal direction and comprises a pair of first platform sections 211 and a pair of second platform sections 212, which in FIG. 6 are arranged to form a continuous longitudinal deck portion. The pair of first and second platform sections 211, 212 are identical and are mounted mirrored side-by-side. The first platform sections 211 are attached to the stern portion 106 by two first transverse pivot joints 213 mounted in-line adjacent the transom that forms a transverse rear portion of the vessel hull 109. The second platform sections 212 are located in front of the first platform sections 211 and are attached to the stern portion by two second transverse pivot joints 214 mounted adjoining the first transverse pivot joints 213 of the first platform sections 211. In this configuration, the first platform sections 211 form a substantially horizontal rear platform section, extending rearwards past the transom, and the second platform sections 212 form a substantially horizontal front platform section. The platform configuration in FIG. 6 is used when the marine propulsion units 201, 202 are in their drive positions, in which they are used to propel the marine vessel. Alternatively, when the propulsion units 201, 202 is not being operated, this platform configuration can be used as a swim platform.

Figure 7:
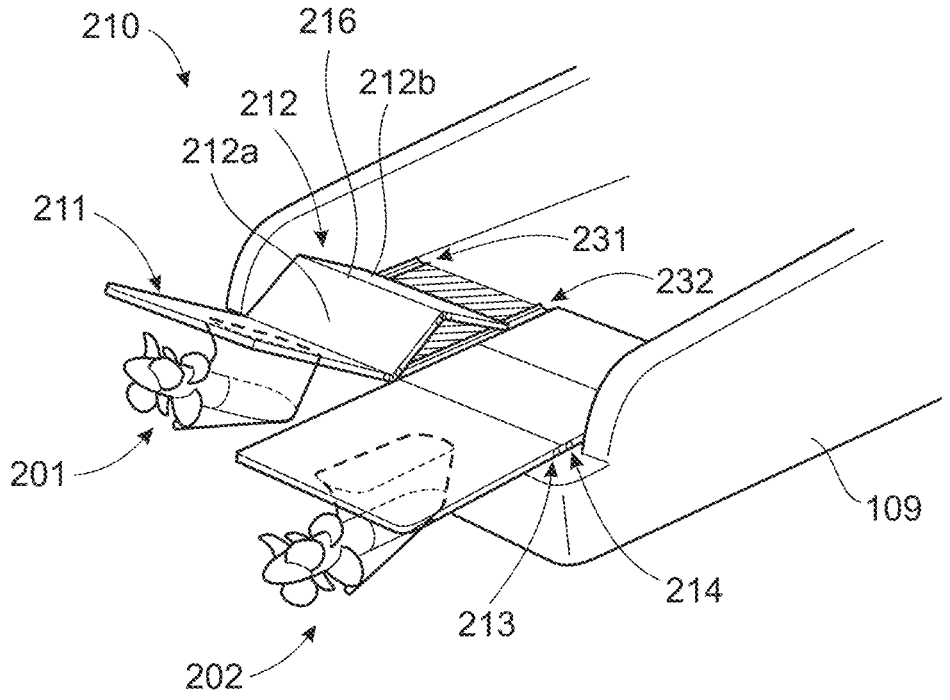
FIG. 7 shows a schematic perspective view of a partially folded seating unit for a split platform arrangement.

FIG. 7 shows a schematic perspective view of a partially folded seating unit for a split platform arrangement. FIG. 7 shows a schematic perspective view of the platform arrangement 210 in FIG. 6 partially adjusted into an alternative configuration. In the example shown in FIG. 7, the left first platform section 211 is angled upwards and forwards relative to its corresponding first transverse pivot joint 213 when the first propulsion unit 201 has been displaced from its drive position upwards into a tilted position, in the same way as described for FIG. 2. The left first platform section 211 has been angled upwards together with the corresponding left second platform section 212. The second platform section 212 has been angled upwards and rearwards relative to its corresponding second transverse pivot joint 214 at the same time as, or after, the propulsion unit 201 is displaced to its tilted position.

In their respective angled positions, the angled left-hand side first and second platform sections 211, 212 form an individual transverse seating unit when the first propulsion unit 201 is in its tilted position. The angled first and second platform sections 211, 212 are individually adjustable by a user into desired seating positions in a similar way as that described for the single seating unit in FIGS. 2 and 3. For instance, when used as a seat, the first platform section 211 can be folded steplessly upwards to an angle $\alpha$ of 80° from a horizontal plane to form a backrest, while the second platform section 212 can be folded steplessly upwards to an angle ß of 45° from a horizontal plane to form a seat and leg rest when the seating unit is deployed. The second platform section 212 as shown in FIG. 7 is preferably divided into first and second subsections 212*a*, 212*b* connected by a third transverse pivot joint 216. This allows the first subsection 212*a* and the second subsection 212*b*, supporting the thigh and lower leg respectively, to be adjusted into a desired position. As shown in FIG. 2, the second subsection 212*b* can be angled downwards relative to the first subsection 212*a*, but not into a substantially horizontal position, as indicated in FIGS. 2 and 3. In the example shown in FIGS. 6 and 7, the forward ends of the respective second platform sections 212 are instead connected to longitudinal rails 231, 232 in the deck section underneath the respective second platform section 212. In this way, the first and second subsections 212*a*, 212*b* of each seating unit are angled together when the forward end of a second platform section 212 is displaced in a rearward direction into a desired position.

The right-hand side first and second platform sections can be displaced to form a transverse seating unit in the same way as the left-hand side first and second platform sections 211, 212 described above. The relative angles of the transverse seating units can be selected freely by the user, within the limits of a number of controllable actuators connected to the different sections of the seating units. Each side-by-side seating unit is provided with a set of maneuvering actuators as described for FIG. 3 above.

It is to be understood that the present invention is not limited to the embodiments described above and illustrated in the drawings; rather, the skilled person will recognize that many changes and modifications may be made within the scope of the appended claims.

The invention claimed is:

1. A platform arrangement mounted to a stern portion of a marine vessel, wherein the platform arrangement comprises:

at least one first platform section with a first transverse pivot joint mounted adjacent a transom wherein the first transverse pivot joint is located forwards of and above the transom;

at least one propulsion unit mounted to a lower surface of the first platform section, wherein the at least one propulsion unit and the first platform section are tiltable between a drive position and an upwards tilted position.

2. A platform arrangement according to claim 1, wherein the platform arrangement further comprises a second platform section located in front of the at least one first platform section, which second platform section has a second transverse pivot joint mounted adjoining the first transverse pivot joint of a corresponding first platform section; wherein the first and second platform sections are foldable relative to each other about their respective first and second pivot joints.

3. A platform arrangement according to claim 1, wherein the at least one first platform section is arranged to extend rearwards from the first transverse pivot joint when the at least one propulsion unit is in its drive position.

4. A platform arrangement according to claim 1, wherein the at least one first platform section is arranged to be angled about the first transverse pivot joint for trim adjustment when the at least one propulsion unit is in its drive position.

5. A platform arrangement according to claim 1, wherein the first platform section and the second platform section form a continuous longitudinal deck portion when the at least one propulsion unit is in its drive position.

6. A platform arrangement according to claim 5, wherein the at least one first platform section is arranged to be angled upwards and forwards relative to the first transverse pivot joint when the at least one propulsion unit is displaced to its tilted position.

7. A platform arrangement according to claim 6, wherein the second platform section is arranged to be angled upwards and rearwards relative to the second transverse pivot joint when the at least one propulsion unit is displaced to its tilted position.

8. A platform arrangement according to claim 7, wherein the angled first and second platform sections form a transverse seating unit when the at least one propulsion unit is in its tilted position.

9. A platform arrangement according to claim 8, wherein individual first and second platform sections form a transverse seating unit for each propulsion unit when that propulsion unit is in its tilted position.

10. A platform arrangement according to claim 8, wherein each of the first and the second platform sections forming a transverse seating unit are individually adjustable.

11. A platform arrangement according to claim 1, wherein the first and second pivot joints are arranged in parallel.

12. A platform arrangement according to claim 1, wherein the first and second pivot joints are arranged coaxially.

13. A platform arrangement according to claim 1, wherein the first platform section is folded upwards to an angle of 90-180° from the drive position for servicing of the at least one propulsion unit.

14. A platform arrangement according to claim 13, wherein the at least one propulsion unit is an electric motor.

15. A marine vessel, including:

a platform arrangement mounted to a stern portion of the marine vessel, wherein the platform arrangement comprises:

at least one first platform section with a first transverse pivot joint mounted adjacent a transom wherein the first transverse pivot joint is located forwards of and above the transom;

at least one propulsion unit mounted to a lower surface of the first platform section, wherein the at least one propulsion unit and the first platform section are tiltable between a drive position and an upwards tilted position.

* * * * *